US006187403B1

(12) United States Patent
Richardson

(10) Patent No.: US 6,187,403 B1
(45) Date of Patent: Feb. 13, 2001

(54) PREFORMED GIFT WRAP

(76) Inventor: Cecil A. Richardson, 1840 NE. 142nd St. #6S, North Miami, FL (US) 33181

( * ) Notice: Under 35 U.S.C. 154(b), the term of this patent shall be extended for 0 days.

(21) Appl. No.: 09/116,982

(22) Filed: Jul. 16, 1998

(51) Int. Cl.[7] ..... B65D 65/14

(52) U.S. Cl. ..... 428/40.1; 229/103.3; 229/87.01; 229/87.18; 229/87.19; 229/923; 428/42.1; 428/42.2; 428/121; 428/130; 428/192; 428/194

(58) Field of Search ..... 428/40.1, 42.1, 428/42.2, 121, 130, 192, 194; 229/103.3, 923, 87.01, 87.18, 87.19

(56) References Cited

U.S. PATENT DOCUMENTS 4,858,822 * 8/1989 Johnson ..... 229/137
5,337,943 * 8/1994 Hendren ..... 229/87.19

* cited by examiner

*Primary Examiner*—Nasser Ahmad

(57) ABSTRACT

A preformed gift wrap for quickly and easily wrapping a gift box. The preformed gift wrap includes a generally rectangular sheet having a pair of spaced apart lateral fold lines extending between the sides of the sheet which divide the sheet into three generally rectangular panels. Extending from each side of the middle second panel is a generally trapezoidal middle flap. Each of the middle flaps is foldable along a line extending along the associated side of the sheet. Extending from each side of the outer first and third panels is a side flap. Each of the side flaps is foldable along a line extending along the associated side of the sheet. Each of the sides of the sheet also has two corner flaps extending therefrom such that a first pair of corner flaps are positioned adjacent the first panel and a second pair of corner flaps are positioned adjacent the third panel. The first pair of corner flaps is located between the side flaps adjacent the first panel and the middle flaps while the second pair of corner flaps are located between side flaps adjacent the second panel and the middle flaps such that the middle flaps are interposed between the corner flaps. The interior surface of the sheet has a plurality of adhesive strips provided thereon for attaching the sheet to the exterior of a gift box.

9 Claims, 2 Drawing Sheets

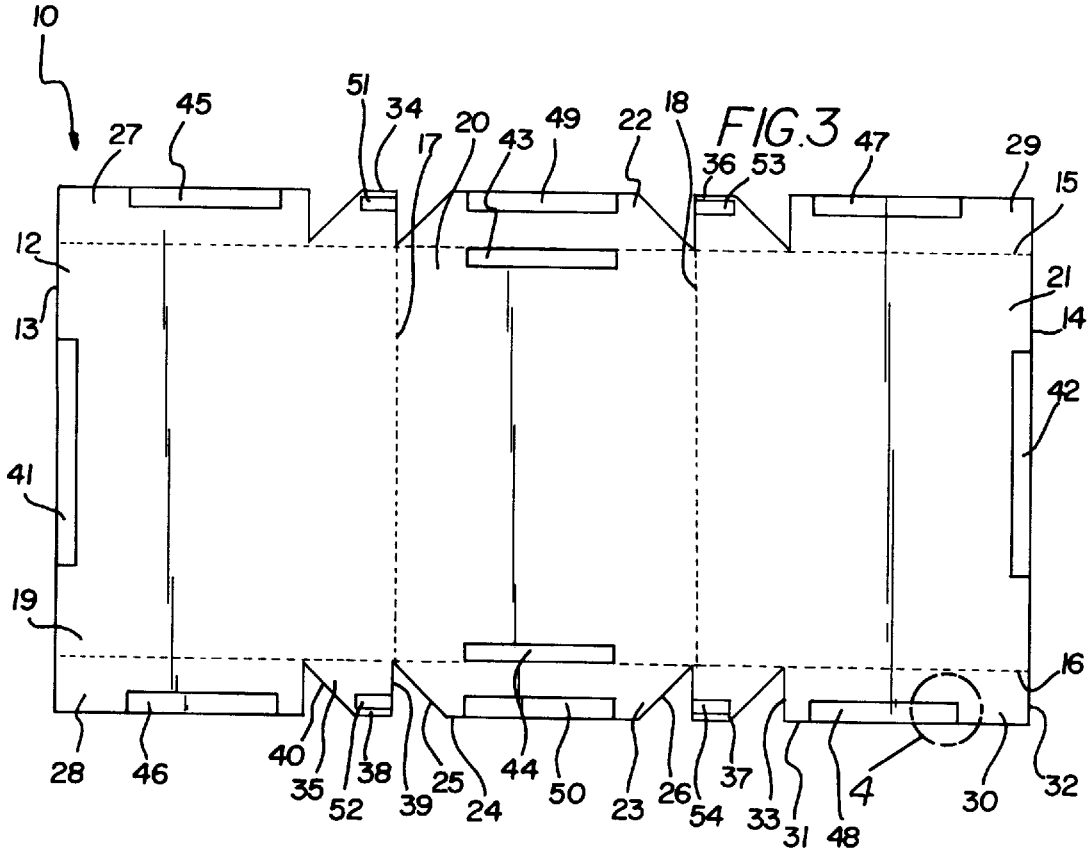
FIG.3
FIG.4
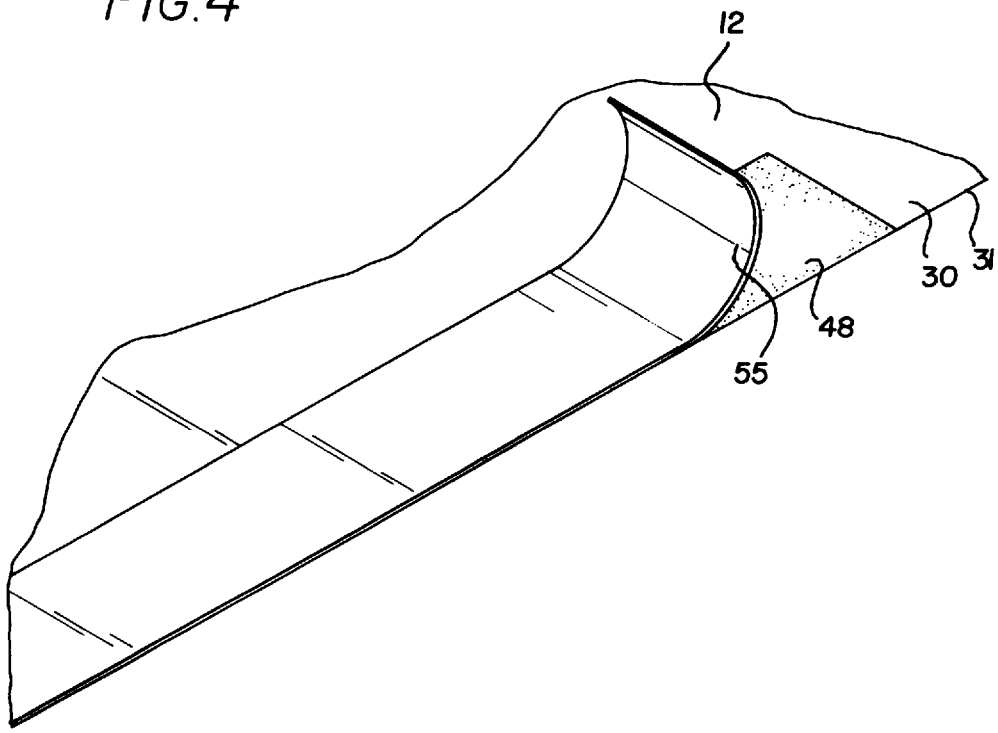

PREFORMED GIFT WRAP

BACKGROUND OF THE INVENTION

1. Field of the Invention

The present invention relates to gift wraps and more particularly pertains to a new preformed gift wrap for quickly and easily wrapping a gift box.

2. Description of the Prior Art

The use of gift wraps is known in the prior art. More specifically, gift wraps heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,337,943; 5,422,151; EPO Patent No. EP 0 496 917 A1 (inventors: Weder et. al.); U.S. Pat. Nos. 3,381,889; 956,590; 5,007,229; and PCT Patent No. 92/12910 (inventor: Triglia).

While these devices fulfill their respective, particular objectives and requirements, the aforementioned patents do not disclose a new preformed gift wrap. The inventive device includes a generally rectangular sheet having a pair of spaced apart lateral fold lines extending between the sides of the sheet which divide the sheet into three generally rectangular panels. Extending from each side of the middle second panel is a generally trapezoidal middle flap. Each of the middle flaps is foldable along a line extending along the associated side of the sheet. Extending from each side of the outer first and third panels is a side flap. Each of the side flaps is foldable along a line extending along the associated side of the sheet. Each of the sides of the sheet also has two corner flaps extending therefrom such that a first pair of corner flaps are positioned adjacent the first panel and a second pair of corner flaps are positioned adjacent the third panel. The first pair of corner flaps is located between the side flaps adjacent the first panel and the middle flaps while the second pair of corner flaps are located between side flaps adjacent the second panel and the middle flaps such that the middle flaps are interposed between the corner flaps. The interior surface of the sheet has a plurality of adhesive strips provided thereon for attaching the sheet to the exterior of a gift box.

In these respects, the preformed gift wrap according to the present invention substantially departs from the conventional concepts and designs of the prior art, and in so doing provides an apparatus primarily developed for the purpose of quickly and easily wrapping a gift box.

SUMMARY OF THE INVENTION

In view of the foregoing disadvantages inherent in the known types of gift wraps now present in the prior art, the present invention provides a new preformed gift wrap construction wherein the same can be utilized for quickly and easily wrapping a gift box.

The general purpose of the present invention, which will be described subsequently in greater detail, is to provide a new preformed gift wrap apparatus and method which has many of the advantages of the gift wraps mentioned heretofore and many novel features that result in a new preformed gift wrap which is not anticipated, rendered obvious, suggested, or even implied by any of the prior art gift wraps, either alone or in any combination thereof.

To attain this, the present invention generally comprises a generally rectangular sheet having a pair of spaced apart lateral fold lines extending between the sides of the sheet which divide the sheet into three generally rectangular panels. Extending from each side of the middle second panel is a generally trapezoidal middle flap. Each of the middle flaps is foldable along a line extending along the associated side of the sheet. Extending from each side of the outer first and third panels is a side flap. Each of the side flaps is foldable along a line extending along the associated side of the sheet. Each of the sides of the sheet also has two corner flaps extending therefrom such that a first pair of corner flaps are positioned adjacent the first panel and a second pair of corner flaps are positioned adjacent the third panel. The first pair of corner flaps is located between the side flaps adjacent the first panel and the middle flaps while the second pair of corner flaps are located between side flaps adjacent the second panel and the middle flaps such that the middle flaps are interposed between the corner flaps. The interior surface of the sheet has a plurality of adhesive strips provided thereon for attaching the sheet to the exterior of a gift box.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new preformed gift wrap apparatus and method which has many of the advantages of the gift wraps mentioned heretofore and many novel features that result in a new preformed gift wrap which is not anticipated, rendered obvious, suggested, or even implied by any of the prior art gift wraps, either alone or in any combination thereof.

It is another object of the present invention to provide a new preformed gift wrap which may be easily and efficiently manufactured and marketed.

It is a further object of the present invention to provide a new preformed gift wrap which is of a durable and reliable construction.

An even further object of the present invention is to provide a new preformed gift wrap which is susceptible of a low cost of manufacture with regard to both materials and labor, and which accordingly is then susceptible of low prices of sale to the consuming public, thereby making such preformed gift wrap economically available to the buying public.

Still yet another object of the present invention is to provide a new preformed gift wrap which provides in the apparatuses and methods of the prior art some of the advantages thereof, while simultaneously overcoming some of the disadvantages normally associated therewith.

Still another object of the present invention is to provide a new preformed gift wrap for quickly and easily wrapping a gift box.

Yet another object of the present invention is to provide a new preformed gift wrap which includes a generally rectangular sheet having a pair of spaced apart lateral fold lines extending between the sides of the sheet which divide the sheet into three generally rectangular panels. Extending from each side of the middle second panel is a generally trapezoidal middle flap. Each of the middle flaps is foldable along a line extending along the associated side of the sheet. Extending from each side of the outer first and third panels is a side flap. Each of the side flaps is foldable along a line extending along the associated side of the sheet. Each of the sides of the sheet also has two corner flaps extending therefrom such that a first pair of corner flaps are positioned adjacent the first panel and a second pair of corner flaps are positioned adjacent the third panel. The first pair of corner flaps is located between the side flaps adjacent the first panel and the middle flaps while the second pair of corner flaps are located between side flaps adjacent the second panel and the middle flaps such that the middle flaps are interposed between the corner flaps. The interior surface of the sheet has a plurality of adhesive strips provided thereon for attaching the sheet to the exterior of a gift box.

Still yet another object of the present invention is to provide a new preformed gift wrap that saves time and energy when wrapping a gift.

Even still another object of the present invention is to provide a new preformed gift wrap that provides a neat wrap for a gift every time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic side view of the interior surface of the present invention.

FIG. 4 is a schematic perspective view of an adhesive strip of the present invention taken from the circle 4 on FIG. 3.

DESCRIPTION OF THE PREFERRED EMBODIMENT

Figure 1:
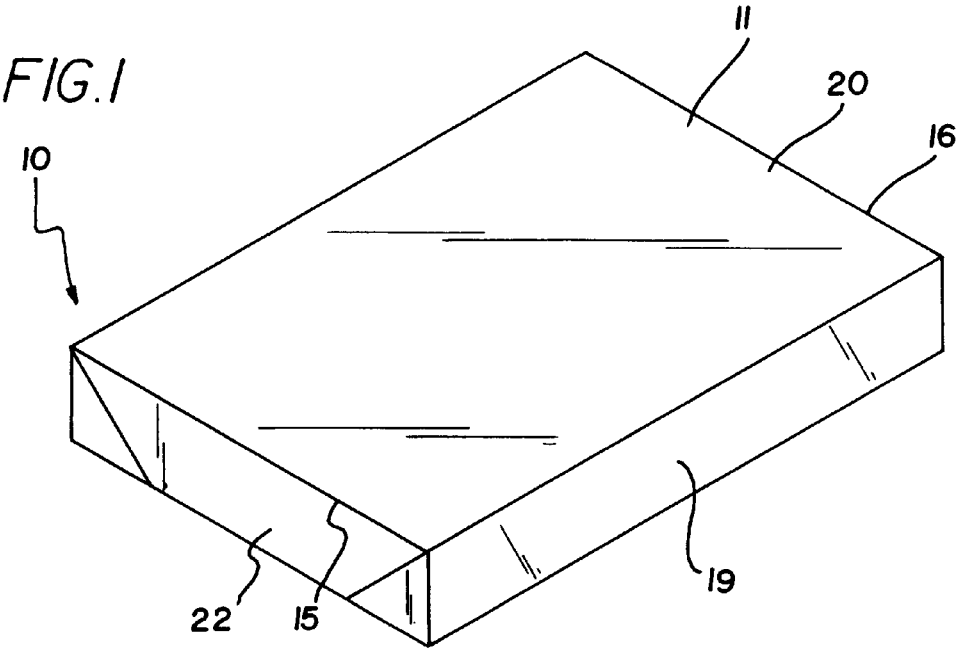
FIG. 1 is a schematic perspective view of an upright gift box wrapped with a new preformed gift wrap according to the present invention.
Figure 2:
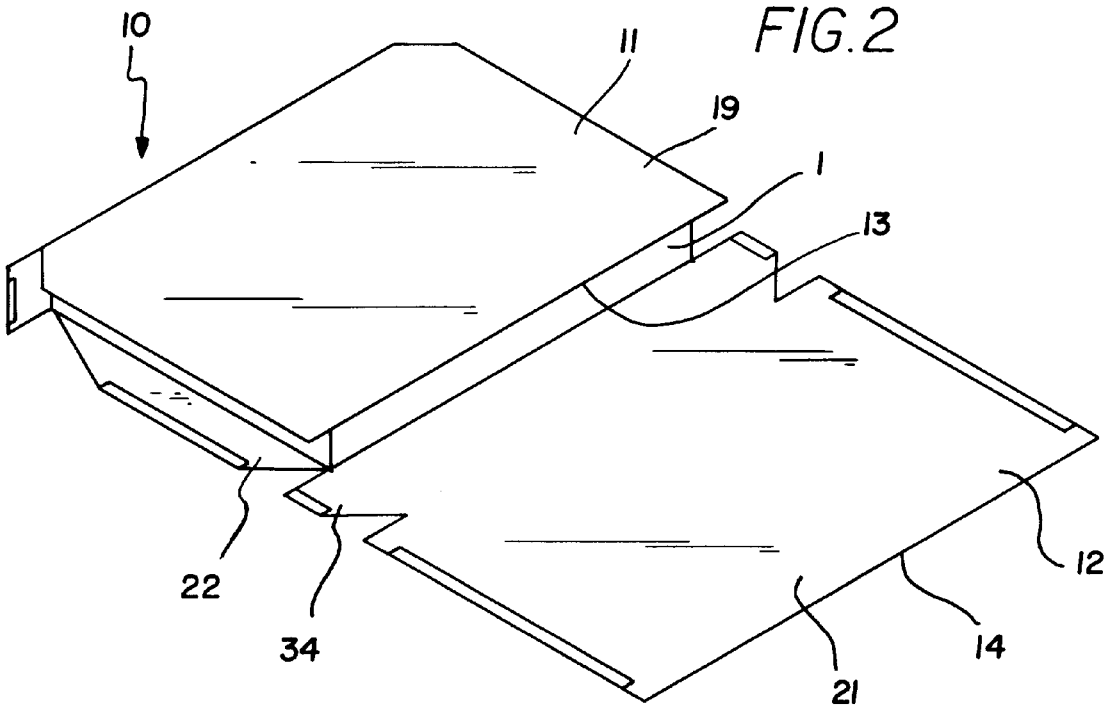
FIG. 2 is a schematic perspective view of an inverted gift box being wrapped with the present invention.

With reference now to the drawings, and in particular to FIGS. 1 through 4 thereof, a new preformed gift wrap embodying the principles and concepts of the present invention and generally designated by the reference numeral 10 will be described.

As best illustrated in FIGS. 1 through 4, the preformed gift wrap 10 generally comprises a generally rectangular sheet 10 having a pair of spaced apart lateral fold lines 17,18 extending between the sides 15,16 of the sheet 10 which divide the sheet 10 into three generally rectangular panels 19,20,21. Extending from each side of the middle second panel 20 is a generally trapezoidal middle flap 22,23. Each of the middle flaps 22,23 is foldable along a line extending along the associated side 15,16 of the sheet 10. Extending from each side of the outer first and third panels 19,21 is a side flap 27,28,29,30. Each of the side flaps 27,28,29,30 is foldable along a line extending along the associated side 15,16 of the sheet 10. Each of the sides 15,16 of the sheet 10 also has two corner flaps 34,35,36,37 extending therefrom such that a first pair of corner flaps 34,35 are positioned adjacent the first panel 19 and a second pair of corner flaps 36,37 are positioned adjacent the third panel 21. The first pair of corner flaps 34,35 is located between the side flaps 27,28 adjacent the first panel 19 and the middle flaps 22,23 while the second pair of corner flaps 36,37 are located between side flaps 29,30 adjacent the second panel 20 and the middle flaps 22,23 such that the middle flaps 22,23 are interposed between the corner flaps 34,35,36,37. The interior surface 12 of the sheet 10 has a plurality of adhesive strips 41,42,43,44,45,46,47,48,49,50,51,52,53,54 provided thereon for attaching the sheet 10 to the exterior of a gift box 1.

In closer detail, the generally rectangular sheet 10 has exterior and interior surfaces 11,12, a pair of generally straight ends 13,14 and a pair of generally straight sides 15,16 extending between the ends 13,14 of the sheet 10. Preferably, the exterior surface 11 of the sheet 10 has decorative images thereon like traditional gift wrap. The sheet 10 has a pair of spaced apart lateral fold lines 17,18 extending between the sides 15,16 of the sheet 10. The lateral fold lines 17,18 are extended generally parallel to the ends 13,14 of the sheet 10 and generally perpendicular to the sides 15,16 of the sheet 10. The lateral fold lines 17,18 divide the sheet 10 into three generally rectangular panels which include first, second, and third panels 19,20,21. The second panel 20 is positioned between the first and third panels 19,21. Preferably, the first and third panels 19,21 have generally equal dimensions, that is, they preferably have generally equal widths and lengths.

Each of the panels 19,20,21 of the sheet 10 has a portion of each of the sides 15,16 of the sheet 10. Each of the portions of the sides 15,16 of the second panel 20 has a generally trapezoidal middle flap 22,23 extending therefrom that are each foldable along a line extending along the associated side 15,16 of the sheet 10. Each of the middle flaps 22,23 has a generally straight side edge 24 extending generally parallel to the associated side of the sheet 10 and a pair of generally straight end edges 25,26 extending at an oblique angle with respect to the side edge 24 of the respective middle flap.

Each of the portions of the sides 15,16 of the first and third panels 19,20 has a side flap 27,28,29,30 extending therefrom. Each of the side flaps 27,28,29,30 is foldable along a line extending along the associated side 15,16 of the sheet 10. Each of side flaps 27,28,29,30 has a generally straight side edge 31 extending generally parallel to the associated side of the sheet 10 and a generally straight outer end edge 32 positioned adjacent the end 13,14 of the sheet 10 located adjacent the respective panel 19,21. Preferably, the outer end edges 32 of the side flaps 27,28,29,30 are generally collinear with the adjacent associated end 13,14 of the sheet 10 and generally perpendicular to the sides 15,16 of the sheet 10. Each of the side flaps 27,28,29,30 also has a generally straight inner end edge 33 with the inner end edges 33 of the side flaps on the same side of the sheet facing each other. The inner end edges of the side flaps are extended at an obtuse angle to the associated side of the sheet.

Each of the sides 15,16 of the sheet 10 also has two corner flaps 34,35,36,37 extending therefrom such that a first pair of corner flaps 34,35 are positioned adjacent the first panel 19 and a second pair of corner flaps 36,37 are positioned adjacent the third panel 21. The first pair of corner flaps 34,35 are positioned between the side flaps 27,28 adjacent the first panel 19 and the middle flaps 22,23 while the second pair of corner flaps 36,37 are positioned between side flaps 29,30 adjacent the second panel 20 and the middle flaps 22,23 such that the middle flaps 22,23 are interposed between the corner flaps 34,35,36,37. Each of the corner flaps 34,35,36,37 has a side edge 38 and inner and outer end edges 39,40. The side edges 38 of the corner flaps are extended generally parallel to the associated side 15,16 of the sheet 10 and generally perpendicular to the ends 13,14 of the sheet 10. The outer end edges 40 of the first pair of corner flaps 34,35 face in a direction away from the outer end edges of the second pair of corner flaps 36,37 while the inner end edges 39 of the first pair of corner flaps 34,35 face towards the inner end edges of the second pair of corner flaps 36,37. The outer side edges 40 of the corner flaps are extended at an obtuse angle to the associated adjacent side 15,16 of the sheet 10. The inner side edges 39 of the first pair of corner flaps 34,35 are collinear with the lateral fold line 17 of the sheet 10 between the first and second panels 19,20 while the inner side edges 39 of the second pair of corner flaps 36,37 are collinear with the lateral fold line 18 of the sheet 10 between the second and third panels 20,21.

The interior surface 12 of the sheet 10 has a plurality of adhesive strips provided thereon. Each of the adhesive strips being generally rectangular and has a length and preferably has a removable protective backing sheet 55 covering the adhesive until it is peeled off. Each of the ends 13,14 of the sheet 10 has an adhesive strip 41,42 located thereadjacent with the lengths of the adhesive strips 41,42 extended generally parallel to the ends 13,14 of the sheet 10. Each of the sides 15,16 of the sheet 10 also has an adhesive strip 43,44 located thereadjacent on the second panel 20 adjacent each of the middle flaps 22,23. The lengths of these adhesive strips 43,44 are extended generally parallel to the sides 15,16 of the sheet 10. Each of the side flaps 27,28,29,30 has an adhesive strip 45,46,47,48 located thereon adjacent the side edge 31 of the respective side flap. Each of the middle flaps 22,23 has an adhesive strip 49,50 located thereon adjacent the side edge 24 of the respective middle flap. Each of the corner flaps 34,35,36,37, also has an adhesive strip 51,52,53,54 located thereon.

In use, the preformed gift wrap 10 is designed for wrapping a generally rectangular gift box 1. First, the top face of a gift box 1 is placed on the second panel 20. The top of the gift box should generally have the same dimensions as the second panel 20. The second panel 20 is then attached to the gift box 1 with the adhesive strips 43,44 on the second panel 20. The first panel 19 is folded around one side of the gift box to cover part or most of the back face of the gift box. The first panel 19 is then attached to the back face of the gift box with the adhesive strip 41 on the end of the first panel 19. Next, the side flaps 27,28 on the first panel 19 are folded over the ends of the gift box and attached with the adhesive strips 45,46 on these side flaps. In a similar fashion as the first panel, the third panel 21 is then folded around the other side of the gift box to cover part or most of the back face of the gift box and part or most of the first panel 19 on the back face of the gift box. The third panel 21 is attached to the back face of the gift box with the adhesive strip 42 on the end of the third panel 21. The side flaps 29,30 on the third panel 21 are then folded over the ends of the gift box and attached with the adhesive strips 47,48 on these side flaps. Next, the corner flaps 34,35,36,37 are folded from the sides of the gift box over their adjacent end of the gift box to cover part of the folded over side flaps on each end of the gift box. The corner flaps are then attached in place on the ends of the gift box with their adhesive strips 51,52,53,54. Finally, the middle flaps 22,23 are folded over the ends of the gift box and attached with the adhesive strips 49,50 on these middle flaps 22,23 to complete the wrapping of the gift box which can now be inverted so that the top of the gift box faces upwards.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An performed gift wrap for wrapping a generally rectangular gift box, said preformed gift wrap comprising:

a generally rectangular sheet having exterior and interior surface, pair of ends and a pair of sides extending between said ends of said sheet;

said sheet having a pair of spaced apart lateral fold lines extending between said sides of said sheet, said lateral fold lines being extended generally parallel to said ends of said sheet;

said lateral fold lines dividing said sheet into three generally rectangular panels, said panels of said sheet including first, second, and third panels, said second panel being positioned between said first and third panels;

a pair of sides of said second panel having a generally trapezoidal middle flap extending therefrom, each of said middle flaps being foldable along a line extending along the associated side of said sheet;

a side of said first and third panels having a side flap extending therefrom, each of said side flaps being foldable along a line extending along the associated side of said sheet;

each of said sides of said sheet having two corner flaps extending therefrom such that a first pair of corner flaps are positioned adjacent said first panel, and a second pair of corner flaps are positioned adjacent said third panel, said first pair of corner flaps being positioned between said side flaps adjacent said first panel and said middle flaps and said second pair of corner flaps being positioned between side flaps adjacent said third panel and said middle flaps such that said middle flaps are interposed between said corner flaps;

said interior surface of said sheet having a plurality of adhesive strips provided thereon for attaching said sheet to the exterior of a gift box; and wherein each of said sides of said sheet has an adhesive strip of said plurality of adhesive strips located thereadjacent, said adhesive strip of each of said sides of said sheet being located on said second panel adjacent the middle flap adjacent the respective side, said lengths of said adhesive strips adjacent said of said sheet being extended generally parallel to said sides of said sheet.

2. The performed gift wrap of claim 1, wherein each of said middle flaps has a generally straight side edge extending generally parallel to the associated side of said sheet, each of said middle flaps having a pair of generally straight end extending at an oblique angle with respect to the side edge of the respective middle flap.

3. The preformed gift wrap of claim 1, wherein each of side flaps has a generally straight side edge extending generally parallel to the associated side of said sheet, wherein each of said side flaps has a generally straight outer end edge positioned the adjacent end of said sheet located adjacent the respective panel, said outer end edges of said side flaps being generally collinear with the adjacent associated end of said sheet and generally perpendicular to said sides of said sheet, and wherein each of said side flaps has a generally straight inner end edge located between said ends of said sheet, said inner end edges of the side flaps on the same side of said sheet facing each other, said inner end edges of said side flaps being extended at an obtuse angle to the associated side of said sheet.

4. The preformed gift wrap of claim 1, wherein each of said corner flaps has a side edge and inner and outer end edges, said side edges of said corner flaps being extended generally parallel to the associated side of said sheet and generally perpendicular to said ends of said sheet, wherein said outer end edges of said first pair of corner flaps face in a direction away from said outer end edges of said second pair of corner flaps, said inner end edges of said first pair of corner flaps facing towards said inner end edges of said second pair of corner flaps, wherein said outer side edges of said corner flaps being extended at an obtuse angle to the associated adjacent side of said sheet and wherein said inner side edges of said first pair of corner flaps are collinear with said lateral fold line of said sheet between said first and second panels, said inner side edges of said second pair of corner flaps being collinear with said lateral fold line of said sheet between said second and third panels.

5. The preformed gift wrap of claim 1, wherein each of said ends of said sheet has an adhesive strip of said plurality of adhesive strips located thereadjacent, said lengths of said adhesive strips adjacent said ends of said sheet being extended generally parallel to said ends of said sheet.

6. The preformed gift wrap of claim 1, wherein each of said side flaps has an adhesive strip of said plurality adhesive strips located thereon, said adhesive strip of each of said side flaps being located adjacent the side edge of the respective side flap.

7. The preformed gift wrap of claim 1, wherein each of said middle flaps has an adhesive strip of said plurality of adhesive strips located thereon, said adhesive strip of each of said middle flaps being located adjacent the side of the respective middle flap.

8. The performed gift wrap of claim 1, wherein each of said corner flaps has an adhesive strip of said plurality of adhesive strips located thereon.

9. An preformed gift wrap for wrapping a generally rectangular gift box, said preformed gift wrap comprising:

a generally rectangular sheet having exterior and interior surfaces, a pair of generally straight ends and a pair of generally straight sides extending between said ends of said sheet;

said sheet having a pair of spaced apart lateral fold lines extending between said sides of said sheet, said lateral fold lines being extended generally parallel to said ends of said sheet and generally perpendicular to said sides of said sheet;

said lateral fold lines dividing said sheet into three generally rectangular panels, said panels of said sheet including first, second, and third panels, said second panel being positioned between said first and third panels, said first and third panel having generally equal dimensions;

a pair of sides of said second panel having a generally trapezoidal middle flap extending therefrom, each of said middle flaps being foldable along a line extending along the associated side of said sheet;

each of said middle flaps having a generally straight side edge extending generally parallel to the associated side of said sheet, each of said middle flaps having a pair of generally straight end edges extending at an oblique angle with respect to the side edge of the respective middle flap;

a side of said first and third panels having a side flap extending therefrom, each of said side flaps being foldable along a line extending along the associated side of said sheet;

each of side flaps having a generally straight side edge extending generally parallel to the associated side of said sheet;

each of said side flaps having a generally straight outer end edge positioned the adjacent end of said sheet located adjacent the respective panel, said outer end edges of said side flaps being generally collinear with the adjacent associated end of said sheet and generally perpendicular to said sides of said sheet;

each of said side flaps having a generally straight inner end edge located between said ends of said sheet, said inner end edges of the side flaps on the same side of said sheet facing each other, said inner end edges of said side flaps being extended at an obtuse angle to the associated side of said sheet;

each of said sides of said sheet having two corner flaps extending therefrom such that a first pair of corner flaps are positioned adjacent said first panel, and a second pair of corner flaps are positioned adjacent said third panel, said first pair of corner flaps being positioned between said side flaps adjacent said first panel and said middle flaps and said second pair of corner flaps being positioned between side flaps adjacent said third panel and said middle flaps such that said middle flaps are interposed between said corner flaps;

said interior surface of said sheet having a plurality of adhesive strips provided thereon, each of said adhesive strips being generally rectangular and having a length;

each of said ends of said sheet having an adhesive strip of said plurality of adhesive strips located thereadjacent, said lengths of said adhesive strips adjacent said ends of said sheet being extended generally parallel to said ends of said sheet;

each of said sides of said sheet having an adhesive strip of said plurality of adhesive strips located thereadjacent, said adhesive strip of each of said sides of said sheet being located on said second panel adjacent the middle flap adjacent the respective side, said lengths of said adhesive strips adjacent said side of said sheet being extended generally parallel to said sides of said sheet;

each of said side flaps having an adhesive strip of said plurality of adhesive strips located thereon, said adhesive strip of each of said side flaps being located adjacent the side edge of the respective side flap;

each of said middle flaps having an adhesive strip of said plurality of adhesive strips located thereon, said adhesive strip of each of said middle flaps being located adjacent the side edge of the respective middle flap;

each of said corner flaps having an adhesive strip of said plurality of adhesive strips located thereon;

each of said corner flaps having a side edge and inner and outer end edges, said side edges of said corner flaps being extended generally parallel to the associated side of said sheet and generally perpendicular to said ends of said sheet;

said outer end edges of said first pair of corner flaps facing in a direction away from said outer end edges of said second pair of corner flaps, said inner end edges of said first pair of corner flaps facing towards said inner end edges of said second pair of corner flaps; said outer side edges of said corner flaps being extended at an obtuse angle to the associated adjacent side of said sheet; and said inner side edges of said first pair of corner flaps being collinear with said lateral fold line of said sheet between said first and second panels, said inner side edges of said second pair of corner flaps being collinear with said lateral fold line of said sheet between said second and third panels.

* * * * *